United States Patent [19]

Doucet

[11] Patent Number: 4,753,449

[45] Date of Patent: Jun. 28, 1988

[54] RECREATION THERAPY ENHANCEMENT FOR WHEELCHAIR

[76] Inventor: Barbara A. Doucet, 181 Brown St., No. 3, Waltham, Mass. 02154

[21] Appl. No.: 56,865

[22] Filed: Jun. 1, 1987

[51] Int. Cl.[4] ..... A63D 5/00

[52] U.S. Cl. ..... 280/289 WC; 297/DIG. 4

[58] Field of Search ..... 280/289 R, 289 A, 289 H, 280/289 S, 280 WC, 242 WC; 5/508; 297/DIG. 4; 248/231.6, 231.4; 403/391, 396, 399

[56] References Cited

U.S. PATENT DOCUMENTS 3,709,556 1/1973 Allard et al. ..... 297/DIG. 4
4,368,898 1/1983 Lay ..... 280/289 WC
4,597,140 7/1986 Girard ..... 403/391

*Primary Examiner*—John J. Love
*Assistant Examiner*—Donn McGiehan
*Attorney, Agent, or Firm*—Bromberg, Sunstein & Casselman

[57] ABSTRACT

A recreational therapy attachment is provided for a wheelchair. The attachment includes an arm and clamping means for mounting the arm to a wheelchair such that the longitudinal axis of the arm is substantially perpendicular to the ground, and such that the arm is freely pivotable around its longitudinal axis and freely movable between upper and lower limits along its longitudinal axis. Recreation devices are attached to an end of the arm.

7 Claims, 3 Drawing Sheets

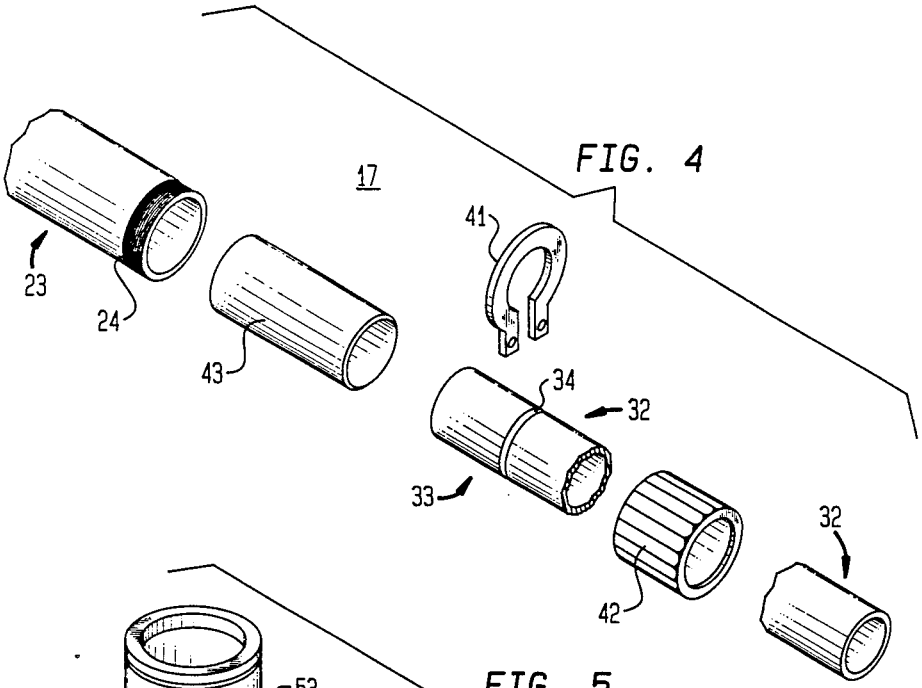
FIG. 4
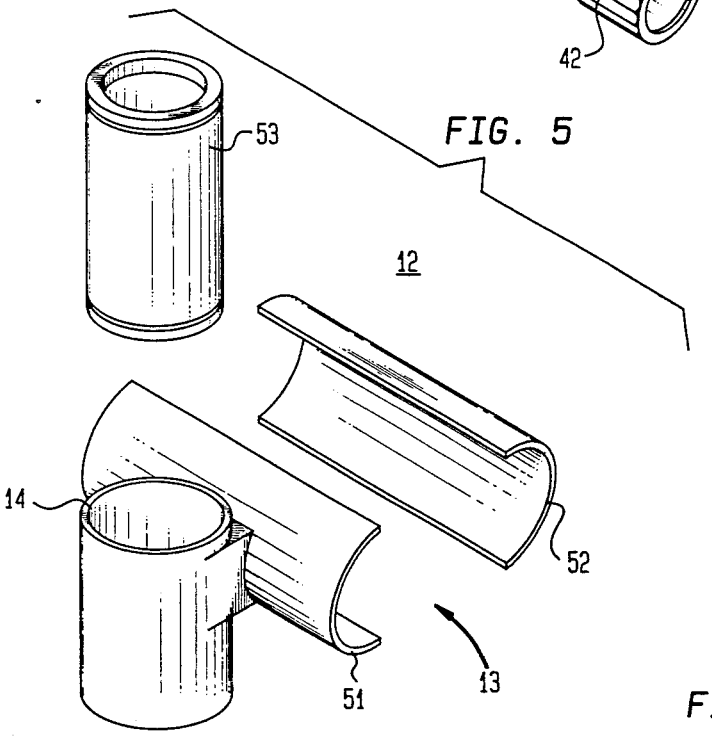
FIG. 5
FIG. 6
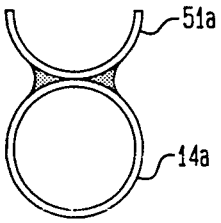

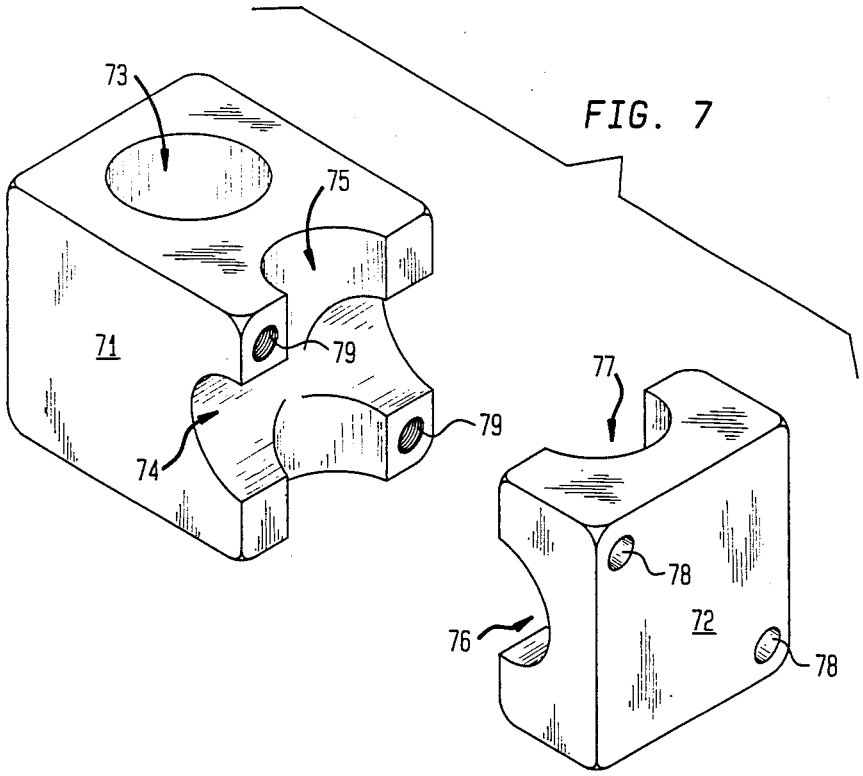
FIG. 7
FIG. 8
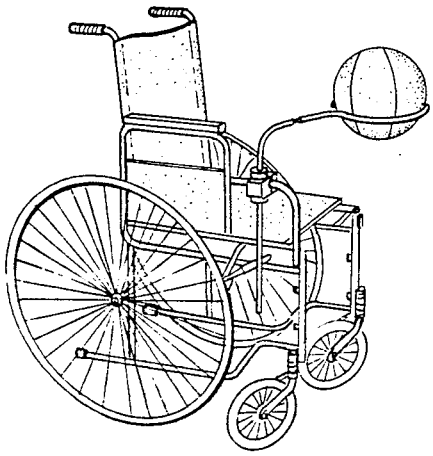

RECREATION THERAPY ENHANCEMENT FOR WHEELCHAIR

DESCRIPTION

1. Field of the Invention

The present invention relates generally to wheelchair attachments, and in particular to those adaptable to recreational use.

2. Background Art

Physicians, therapists, and other health-care professionals have long recognized the therapeutic value of recreational activity to a wide variety of patients. Unfortunately, despite this knowledge, there are few recreational devices specifically designed for a wide range of wheelchair-bound individuals, who may be operating under a variety of upper body limitations.

The prior art contains only limited devices that, for example, enable a person in a wheelchair to bowl, as in U.S. Pat. Nos. 3,083,267, 4,368,898, and 4,470,598. Thus, health-care professionals have been forced to adapt conventional sports and recreation equipment in a makeshift fashion to meet the needs of their patients.

DISCLOSURE OF INVENTION

The present invention provides a versatile recreation attachment for use with standard wheelchairs. A preferred embodiment of a device according to the present invention includes an arm that is pivotally mounted to the side of the wheelchair. Various recreational devices, such as ball holders or block weights, can be attached to the top of the arm. The arm may be positioned so that the particular recreational device is disposed over the lap of the patient. Thus, the patient has easy access to the recreational device without interference with operation of the wheelchair. In another preferred embodiment, a hockey stick, or similar structure, can be attached to the bottom of the arm, permitting a person in a wheelchair to bat a ball or a puck along the floor by maneuvering the top of the arm.

BRIEF DESCRIPTION OF THE DRAWINGS

The foregoing objects and features of the invention are better understood with reference to the following description taken together with the accompanying drawings in which:

FIG. 4 is an exploded perspective view of a preferred embodiment of means for attaching the ball holder to the arm;

FIG. 5 is an exploded perspective view of a preferred embodiment of clamping means for attaching the arm to the wheelchair;

FIG. 6 is a top plan view of an alternative preferred embodiment of clamping means for attaching the arm to the wheelchair;

FIG. 7 is an exploded perspective view of a third preferred embodiment of means for clamping the arm to the wheelchair; and FIG. 8 is a perspective view of a preferred embodiment of the present invention attached to a wheelchair.

DETAILED DESCRIPTION OF SPECIFIC EMBODIMENTS

The use of pivotal mounts both for attaching an arm member to a wheelchair, and for attaching a recreational device to the top of the arm member, allows the therapist to work with the patient on a variety of activities that serve: to develop the range of motion in the patient's upper extremities, including the wrist, elbow, and shoulder; to develop strenth and flexibility in the upper extremities; and to develop flexion and extension of muscle groups. Working with a device according to the present invention also helps the patient to develop various perceptual-motor skills, such as head control, tracking skills, and hand-eye coordination. Cognitive skills are also developed, including spatial concepts such as laterality, directionality, and concepts of weight and mass.

Further, use of the device provides social and psychological therapy as well. The present device allows patients to participate in a variety of specially adapted sports and games, which were previously inacessible. This allows the development of participatory social skills, and further provides the opportunity to use and refine skills developed in physical therapy in a relaxed and congenial environment.

Figure 1:
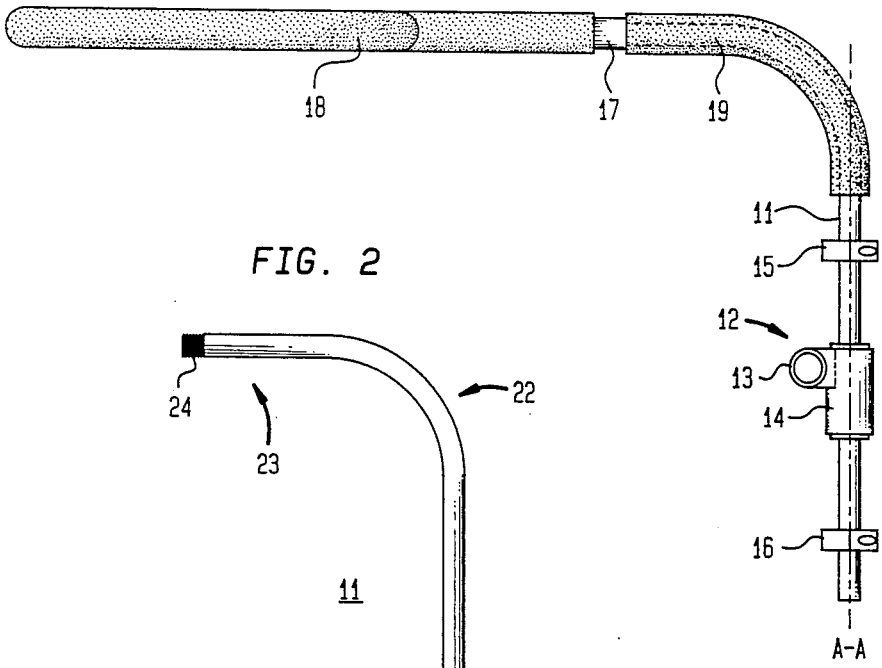
FIG. 1 is a side plan view of a preferred embodiment of a wheelchair attachment according to the present invention.

FIG. 1 shows a side plan view of a preferred embodiment of a wheelchair recreation attachment according to the present invention. This embodiment provides an arm 11 that is attached to a wheelchair by mounting clamp 12. Mounting clamp 12 includes a fitting 13 which fits snugly around a horizontal tubular support structure on the wheelchair. Mounting clamp 12 also includes a socket 14 which receives arm 11. Arm 11 can pivot freely around its longitudinal axis A—A in the socket. Further, arm 11 can move freely up and down along axis A—A within the socket. Adjustable shaft collars 15 and 16 are attached to the lower portion of arm 11 to limit the range of up-and-down movement. The upper end of the arm includes attachment means 17 for pivotally mounting a recreation attachment 18. The recreation attachment 18 can move freely around its longitudinal axis but is restrained from moving along its longitudinal axis by attachment means 17.

Arm 11 is equipped with padding 19 at its elbow. The padding 19 serves a twofold purpose. First, it provides a certain amount of protection to the wheelchair user from accidental sudden impact against the elbow. Second, the padding material 19 provides a gripping surface to facilitate easy maneuvering of the arm. The recreation attachment 18 is preferably padded as well.

Figure 2:
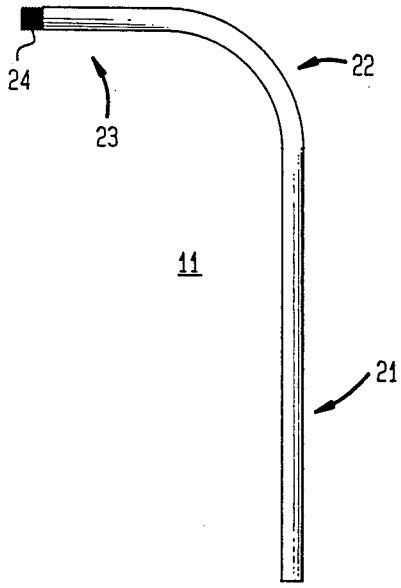
FIG. 2 is a side plan view of a preferred embodiment of an arm member according to the present invention.

FIG. 2 shows a side plan view of a preferred embodiment of the arm shown in FIG. 1. The arm 11 comprises a lower post region 21 that, when attached to the wheelchair, is disposed substantially perpendicular to the ground. The arm 11 further includes an integrally formed elbow section 22 that leads from the lower post region 21 to the upper region 23. As can be seen, upper region 23 is substantially perpendicular to lower region 21, and substantially parallel to the ground. Upper region 23 terminates in a threaded mount 24.

The arm 11 is preferably made of a hollow tube. This is desirable because of weight considerations: a lighter arm is more maneuverable. Further, the use of a hollow tube facilitates mounting of the recreational device to the upper and lower ends. Although a threaded mount is shown at the upper end of the arm, it will be seen that other mounting arrangements can be used with equally satisfactory results in accordance with the present invention.

An alternative embodiment includes the use of a two-piece structure. In that embodiment, the lower post region is a separate piece that nests snugly inside the lower end of the hollow elbow region.

Figure 3:
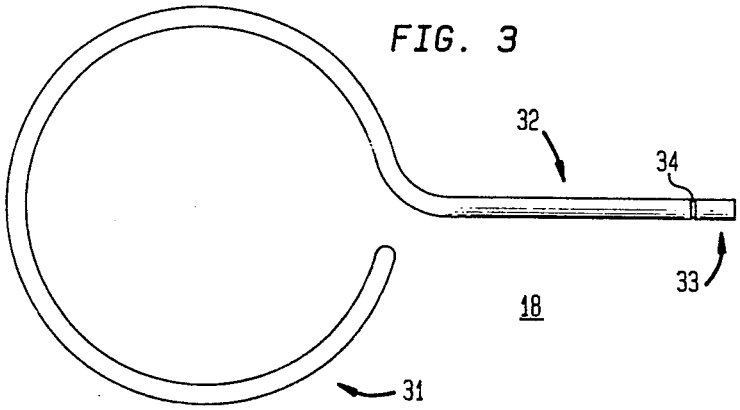
FIG. 3 is a top plan view of a preferred embodiment of a ball holder according to the present invention.

FIG. 3 shows a top plan view of the recreation attachment 18 of FIG. 1. This attachment includes a hoop 31, which is of a size that permits a basketball, or other ball of similar size, to nest comfortably within the hoop. The hoop may thus be used as a ball rest, or as a tee for batting a ball. Further, because of the use of pivoting mounts, it is also possible to "throw" a ball out of the hoop.

The hoop is connected to the arm by stem 32. Mounting end 33 is actually inserted into the arm. As explained below, the mounting end is held in place by a retaining ring inserted into groove 34. As mentioned above, the hoop is preferably padded. The padding serves to protect the user, to secure the ball more firmly in the hoop, and to facilitate handling of the attachment.

FIG. 4 shows a means for pivotally mounting recreation device 18 to arm 11. Mounting end 33 of stem 32 is inserted into the hollow upper portion 23 of the arm 11. Retaining ring 41 is inserted into the corresponding groove 34 in stem 32. Compression nut 42, when screwed onto mounting threads 24, urges the retaining ring 41 against the mouth of the mounting threads 24, thus fixing the stem 32 of recreation device 18 along its longitudinal axis.

The stem 32 can still move freely around its longitudinal axis. This rotation is facilitated by the inclusion of bushing 43, which is a metallic sleeve that fits around mounting end 33. Although a sleeve bushing is shown, it would be possible within the spirit of the invention to use ball bearings instead.

FIG. 5 shows an exploded perspective view of the mounting clamp shown in FIG. 1. As can be seen, fitting 13 includes two complementarily shaped fittings 51 and 52 that, when fastened together, fit snugly around a horizontal tubular support structure on the wheelchair. A bushing 53 is inserted into socket 14 to facilitate the movement of the arm pivotally and up and down, although it would of course be possible to use ball bearings instead.

FIG. 6 shows an alternative preferred embodiment of a mounting clamp. In this embodiment, fitting 51*a* is parallel to socket 14*a*, rather than perpendicular to it. This structure would be desirable, for instance, where a particular wheelchair did not include an appropriate horizontal tubular support structure, but only provided an appropriate vertical tubular support structure.

It would be possible to construct a structure that combines the features of the clamps shown in FIGS. 5 and 6. This structure would include a rivet or other pivoting structure that would permit the fittings to be rotated with respect to the arm socket. Once properly adjusted, the position of the fitting with respect to the arm socket would then be fixed by a bolt or other fastening means.

FIG. 7 shows an exploded perspective view of a third preferred embodiment of a mounting clamp. Mounting block 71 includes a socket 73 for receiving the arm. A sleeve bushing or ball bearing arrangement could be used to facilitate movement of the arm in the socket. Mounting block 71 includes two intersecting troughs 74 and 75 conformal in shape to a wheelchair tubular support structure. Trough 74 is substantially perpendicular to socket 73, and trough 75 is substantially parallel. Troughs 74 and 75 have corresponding troughs 76 and 77 in clamp 72. When clamp 72 is fastened onto mounting block 71, the hole formed by troughs 74 and 76, and the hole formed by troughs 75 and 77, are both equally well dimensioned to snugly receive a tubular structure on a wheelchair, thus obviating the need for separate vertical and horizontal mounting clamps. Clamp 72 is attached to part 71 by screws which are inserted through holes 78 into threaded screw holes 79.

FIG. 8 shows a perspective view of a wheelchair incorporating a recreation therapy attachment according to the present invention. It will be seen that the ball holder is positioned such that the wheelchair user has ready access to the ball without interference with the use of the wheelchair. The mounting block is attached and set at a fixed point as close to the wheelchair arm as possible. Shaft collars 15 and 16 are then used to set the ball holder or other attachment at a fixed height, or are used to set the range in which the arm/attachment may be moved up and down by the user.

What is claimed is:

1. A recreational therapy wheelchair attachment comprising:

an arm having (i) a lower portion and (ii) an upper portion substantially perpendicular to the lower portion;

clamping means for movably mounting the lower portion of the arm to a wheelchair such that (i) the lower portion of the arm is substantially perpendicular to the ground, (ii) the upper portion is substantially parallel to the ground, (iii) the arm is freely rotatably around the longitudinal axis of the lower portion of the arm, and (iv) the arm is freely movable along the longitudinal axis of its lower portion between upper and lower limits; and attachment means at the end of the upper portion of the arm for attaching thereto a recreation device, the recreation device having a longitudinal axis, and the attachment means including means for attaching the recreation device to the top end of the arm such that (i) the longitudinal axis of the recreation device is substantially parallel to the ground and (ii) the recreation device is freely pivotable around its longitudinal axis, such that a wheelchair user may selectably move the recreation device in relation to the wheelchair by (i) rotating the arm around the longitudinal axis of the lower portion of the arm (ii) moving the arm along the longitudinal axis of its lower portion between the upper and lower limits, or (iii) pivoting the recreation device around its longitudinal axis, or (iv) any combination of (i), (ii), or (iii).

2. A wheelchair attachment according to claim 1, wherein the clamping means comprises:

a collar for receiving the arm;

a first fitting mounted to the collar, the first fitting including a first trough conformal in shape to a wheelchair tubular support structure;

a second fitting including a second trough conformal to shape to a wheelchair tubular support structure, the first and second fittings being of complementary shape, such that when the first and second fittings are fastened together, the first and second troughs snugly receive a wheelchair tubular support structure.

3. A wheelchair attachment according to claim 2, wherein the first fitting is mounted substantially perpendicular to the collar.

4. A wheelchair attachment according to claim 2, wherein the first fitting is mount substantially parallel to the collar.

5. A wheelchair attachment according to claim 2, wherein the first fitting is movably mounted to the collar such that the first fitting may be fixed either parallel or perpendicular to the collar.

6. A wheelchair attachment according to claim 1, wherein the clamping means comprises:

a collar for receiving the arm;

a first fitting mounted to the collar, the first fitting including a first trough comformal in shape to a wheelchair tubular support structure, the first trough being substantially perpendicular to the collar, and a second trough conformal in shape to a wheelchair tubular support structure, the second trough being substantially parallel to the collar; and a second fitting including at least one complementary trough conformal in shape to a wheelchair tubular support structure, such that when the first and second fittings are fastened together, the complementary trough together with either the first or the second troughs snugly receive a wheelchair tubular support structure.

7. A wheelchair attachment according to claim 1, wherein the recreation device is a hoop of a size to receive a ball substantially the size of a basketball.

* * * * *